US012096860B2

(12) United States Patent
Yang

(10) Patent No.: US 12,096,860 B2
(45) Date of Patent: Sep. 24, 2024

(54) FOLDABLE CHAIR

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 0 days.

(21) Appl. No.: 17/993,033

(22) Filed: Nov. 23, 2022

(65) Prior Publication Data

US 2023/0165372 A1 Jun. 1, 2023

(30) Foreign Application Priority Data

Nov. 26, 2021 (CN) ..... 202122945221.4

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS

| | | | | |
|---|---|---|---|---|
| 4,072,341 | A | 2/1978 | Kurz | |
| 5,570,926 | A | 11/1996 | Papiernik et al. | |
| 6,179,374 | B1 * | 1/2001 | Tang | A47C 4/286 297/42 |
| 6,692,068 | B1 | 2/2004 | Tang | |
| 6,840,574 | B1 * | 1/2005 | Wu | A47C 7/62 297/188.14 |
| 11,382,427 | B2 | 7/2022 | Yang | |
| 2003/0006632 | A1 | 1/2003 | Ku | |
| 2009/0072592 | A1 | 3/2009 | Zheng | |
| 2010/0237665 | A1 | 9/2010 | Grace | |

FOREIGN PATENT DOCUMENTS

| | | | |
|---|---|---|---|
| CN | 2897032 | Y | 5/2007 |
| CN | 201533682 | U | 7/2010 |
| CN | 202035773 | U | 11/2011 |
| CN | 202820372 | U | 3/2013 |
| CN | 208318773 | U | 1/2019 |
| CN | 211795404 | U * | 10/2020 |
| WO | 9009749 | A1 | 9/1990 |
| WO | 2020120560 | A1 | 6/2020 |

* cited by examiner

*Primary Examiner* — Anthony D Barfield
(74) *Attorney, Agent, or Firm* — Thompson Coburn LLP

(57) ABSTRACT

A chair has a foldable chair that is movable between a folded and expanded configuration. The frame includes two backrest tubes arranged on opposite sides of the frame. Two cross tubes are arranged crosswise between the two backrest tubes. The two cross tubes are rotatably connected to each other. The top of each cross tube is rotatably connected to the corresponding backrest tube. Two backrest supporting tubes extend from a lock catch to a corresponding cross tube. Each back rest supporting tube is rotatably connected to the lock catch, and the other ends of the two backrest supporting tubes are respectively rotatably connected to different cross tubes. The bottom of each cross tube is rotatably connected to an end of a corresponding backrest transverse supporting tube. An opposite end of the backrest transverse supporting tube is rotatably connected to a backrest tube.

19 Claims, 6 Drawing Sheets

FOLDABLE CHAIR

RELATED APPLICATION DATA

The present application claims priority benefit to Chinese Utility Model Patent CN216702063U filed, Nov. 26, 2021, the disclosure of which is incorporated by reference herein.

FIELD

The present application relates to the technical field of foldable chairs, and in particular to a chair frame and a foldable chair having the same.

BACKGROUND

A foldable chair is a kind of chair that is foldable, which is convenient to carry and store, and is widely used in outdoor activities, such as on the beach.

In the foldable chair in the conventional technology, storage and folding of a backrest structure are inconvenient during storage process, thus affecting the use experience.

SUMMARY

An object according to the present application is to provide a chair frame and a foldable chair having the same, where the folding of the backrest structure is convenient to operate, the use thereof is easy, and the use experience thereof is improved.

In order to achieve the above object, a chair frame is provided according to the present application, which includes two backrest tubes which are oppositely arranged, wherein two cross tubes which are crosswise arranged are provided between the two backrest tubes. The two cross tubes are rotatably connected to each other. The top of each cross tube is operatively rotatably connected to the corresponding backrest tube. A lock catch and two backrest supporting tubes are provided between the two cross tubes. The two backrest supporting tubes are respectively located at two ends of the lock catch, and adjacent ends of the two backrest supporting tubes are rotatably connected to the lock catch. The other ends of the two backrest supporting tubes are respectively operatively rotatably connected to different cross tubes. The bottom of each of the two cross tubes is operatively rotatably connected to one end of a corresponding backrest transverse supporting tube. The other ends of the two backrest transverse supporting tubes are operatively rotatably connected to different backrest tubes respectively.

In an embodiment, the bottom of each backrest tube is operatively rotatably connected with a corresponding seat tube. One end of the seat tube is configured to stand on the ground, and the other end of the seat tube is configured to extend upward. The seat tube is further operatively rotatably connected to the top of a corresponding front leg tube. A front supporting tube is slidably connected on the front leg tube. The front supporting tube is rotatable relative to the front leg tube. The top of the front supporting tube is operatively rotatably connected with a corresponding armrest tube, and an end of the armrest tube is operatively rotatably connected to the corresponding backrest tube.

In an embodiment, gear-like teeth are provided inside each armrest tube, and different teeth of the gear-like teeth of the armrest tube cooperate with the top of the corresponding front supporting tube by rotating the backrest tube, to adjust an angle between the backrest tube and the corresponding seat tube.

In an embodiment, the chair frame further includes two front cross tubes which are crosswise arranged and rotatably connected to each other, where one end of each front cross tube is rotatably connected to the corresponding seat tube, and the other end of the front cross tube is connected to the bottom of the corresponding front leg tube.

In an embodiment, the rotational connection position of the two cross tubes is equidistant from the two backrest tubes, and the rotational connection position of the two front cross tubes is equidistant from the two seat tubes.

In an embodiment, the rotational connection position of the front leg tube and the seat tube is closer to the corresponding backrest tube than the rotational connection position of the front supporting tube and the seat tube.

In an embodiment, the two cross tubes and the two backrest transverse supporting tubes are arranged on a side, away from the front supporting tubes, of the backrest tubes.

In an embodiment, the two cross tubes have a same size and are symmetrically arranged, and the two backrest transverse supporting tubes have a same size and are symmetrically arranged.

A foldable chair is further provided according to the present application, which includes the above chair frame.

Compared with the above background technology, the chair frame according to the present application includes the two backrest tubes which are oppositely arranged, wherein the two cross tubes which are crosswise arranged are provided between the two backrest tubes. The two cross tubes are rotatably connected to each other. The top of each cross tube is rotatably connected to the corresponding backrest tube. The lock catch and the two backrest supporting tubes are provided between the two cross tubes. The two backrest supporting tubes are respectively located at two ends of the lock catch. Adjacent ends of the two backrest supporting tubes are rotatably connected to the lock catch, and the other ends of the two backrest supporting tubes are respectively rotatably connected to different cross tubes. The bottom of each of the two cross tubes is rotatably connected to one end of the corresponding backrest transverse supporting tube, and the other ends of the two backrest transverse supporting tubes are rotatably connected to different backrest tubes respectively. When the chair frame with such arrangement needs to be unfolded or expanded, the lock catch is controlled to move downward, so that the two backrest supporting tubes at the two ends of the lock catch are unfolded. Thus the two cross tubes are unfolded, and a distance between the two backrest tubes becomes larger, so that the chair frame is unfolded. When the chair frame needs to be folded, the lock catch can be controlled to move upward. The lock catch is pulled, so that the two backrest supporting tubes are folded. Thus, the two cross tubes are folded, and the distance between the two backrest tubes becomes smaller, so that the chair frame is folded. It can be seen that the folding process of the chair frame is relatively simple and can be realized by only pulling the lock catch, which is convenient to operate, the use thereof is easy, and the use experience thereof is improved.

The foldable chair according to the present application includes the chair frame, and also has the above beneficial effects, which will not be repeated.

BRIEF DESCRIPTION OF THE DRAWINGS

For more clearly illustrating the technical solutions in the embodiments of the present application or the conventional technology, drawings referred to for describing the embodiments or the conventional technology will be briefly described hereinafter. Apparently, the drawings in the following description are only examples of the present application, and for the person skilled in the art, other drawings may be obtained based on the drawings provided without any creative efforts.

Figure 1:
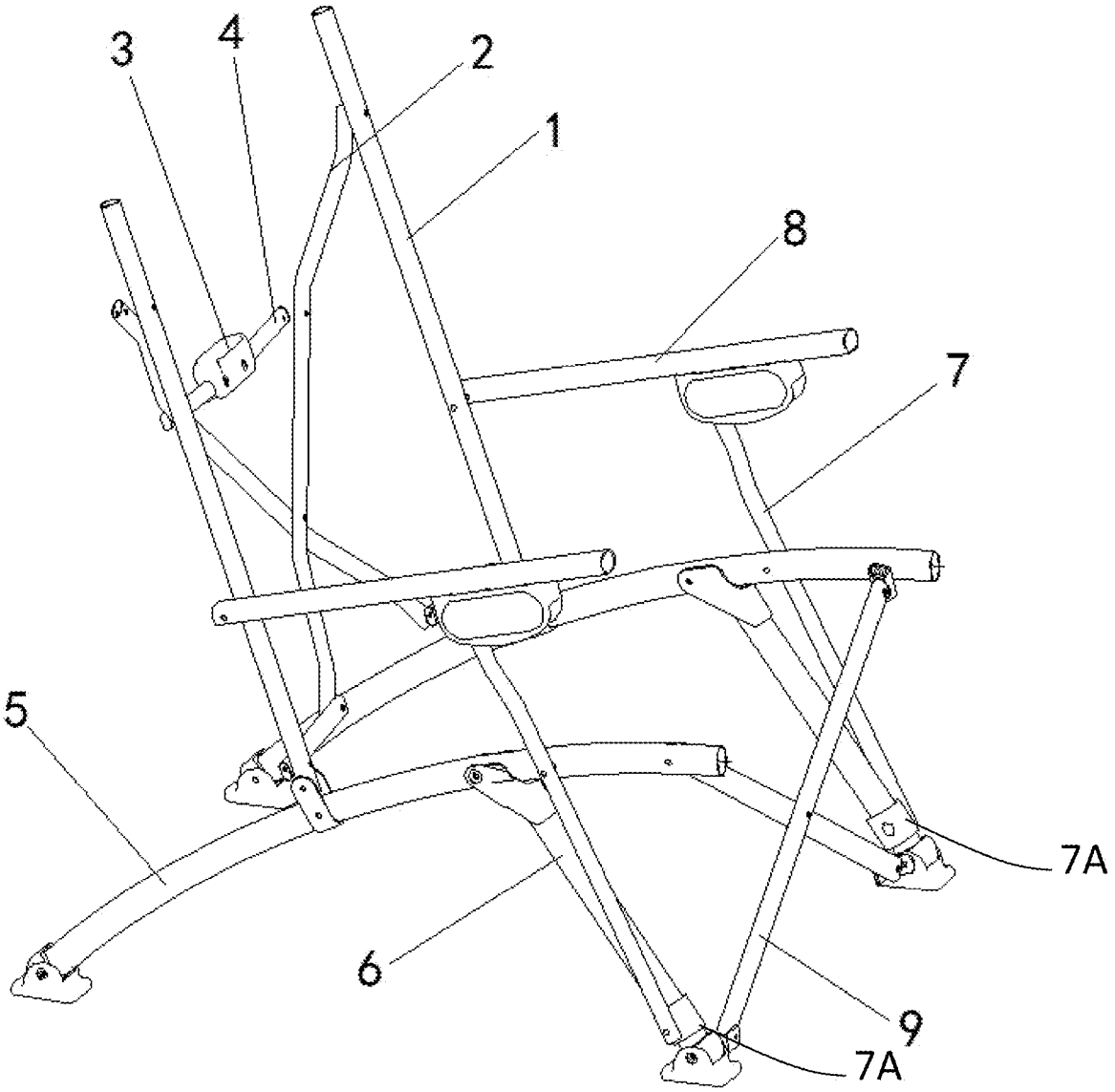
FIG. 1 is a schematic view of a chair frame provided according to an embodiment of the present application.

Reference numerals in the figures:

| | |
|---|---|
| 1 backrest tube, | 2 cross tube, |
| 3 lock catch, | 4 backrest supporting tube, |
| 5 seat tube, | 6 front leg tube, |
| 7 front supporting tube, | 8 armrest tube, |
| 7A slider, | 9 front cross tube, |
| 10 backrest traverse supporting tube. | |

DETAILED DESCRIPTION OF THE EMBODIMENTS

The technical solutions in the embodiments of the present application will be described clearly and completely as follows in conjunction with the drawings in the embodiments of the present application. It is apparent that the described embodiments are only a part of the embodiments according to the present application, rather than all of the embodiments. Based on the embodiments in the present application, all of other embodiments, made by the person skilled in the art without any creative efforts, fall into the scope of protection of the present application.

In order to provide the person skilled in the art with a better understanding of the solution of the present application, the present application is described hereinafter in further detail in conjunction with the drawings and embodiments.

Figure 2:
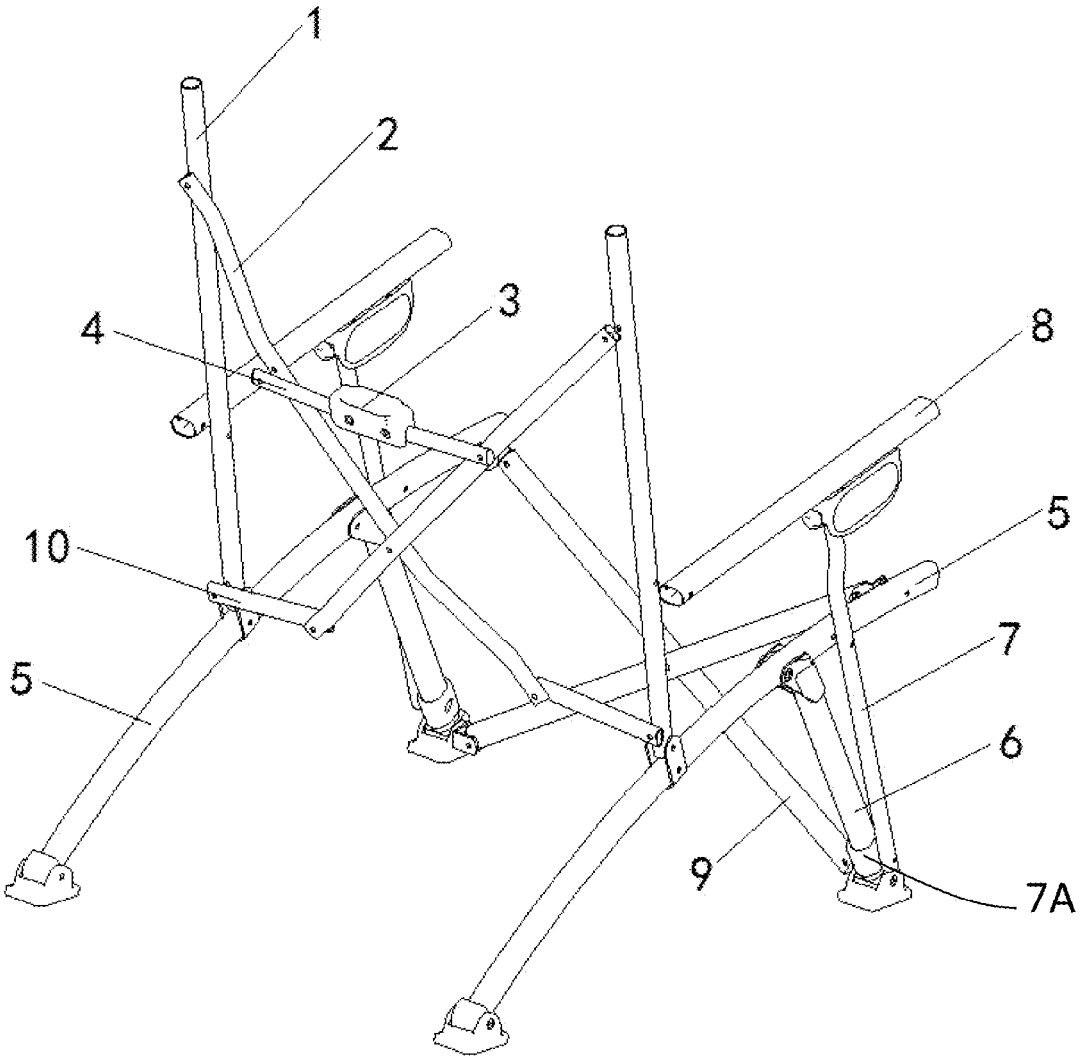
FIG. 2 is a schematic view of the chair frame provided according to the embodiment of the present application viewed from another perspective.
Figure 3:
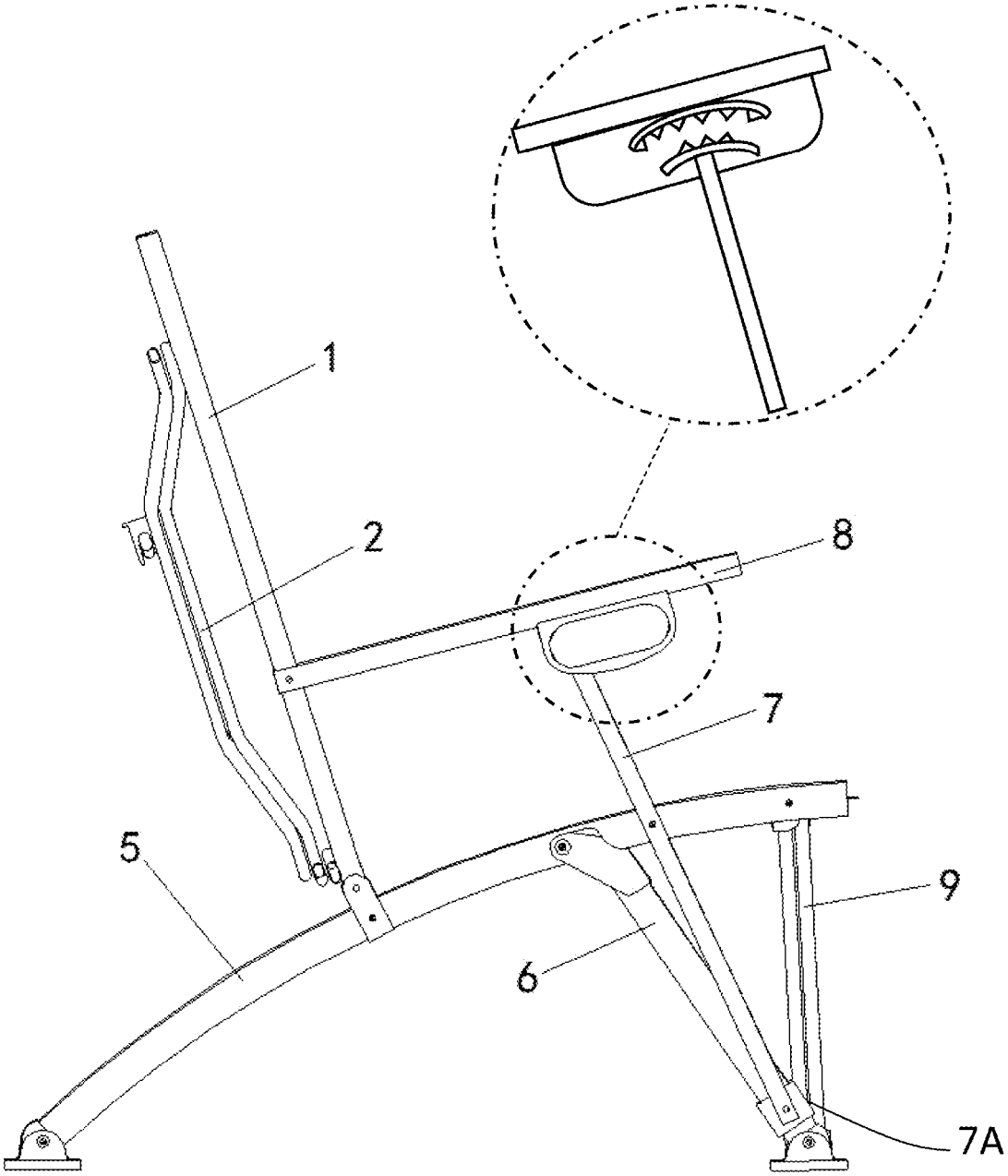
FIG. 3 is a side view of the chair frame provided according to the embodiment of the present application.
Figure 4:
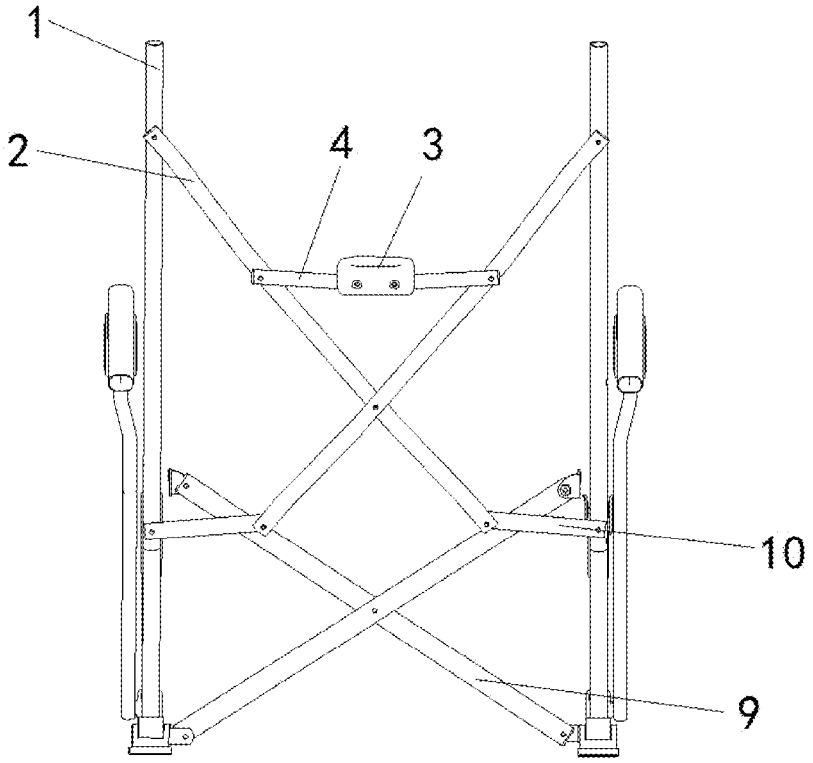
FIG. 4 is a front view of the chair frame provided according to the embodiment of the present application.
Figure 5:
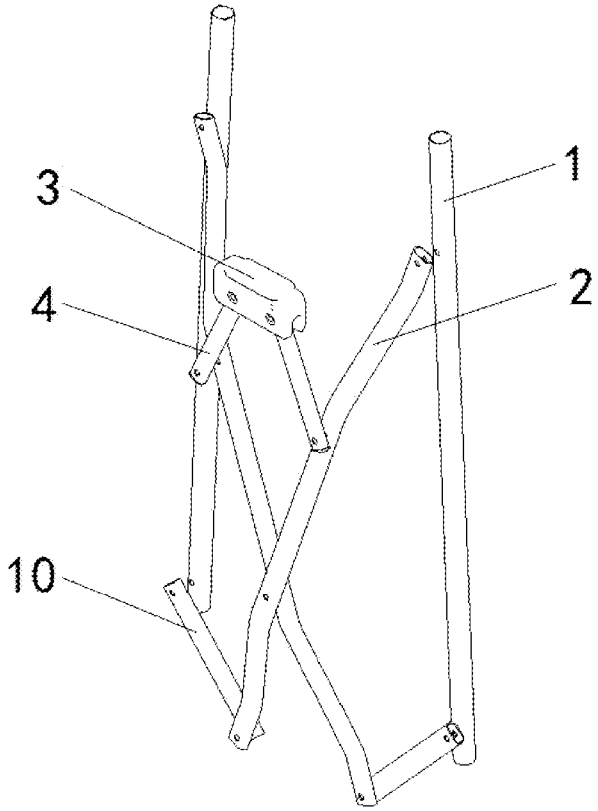
FIG. 5 is a schematic view of a backrest structure of the chair frame provided according to the embodiment of the present application during the folding process.
Figure 6:
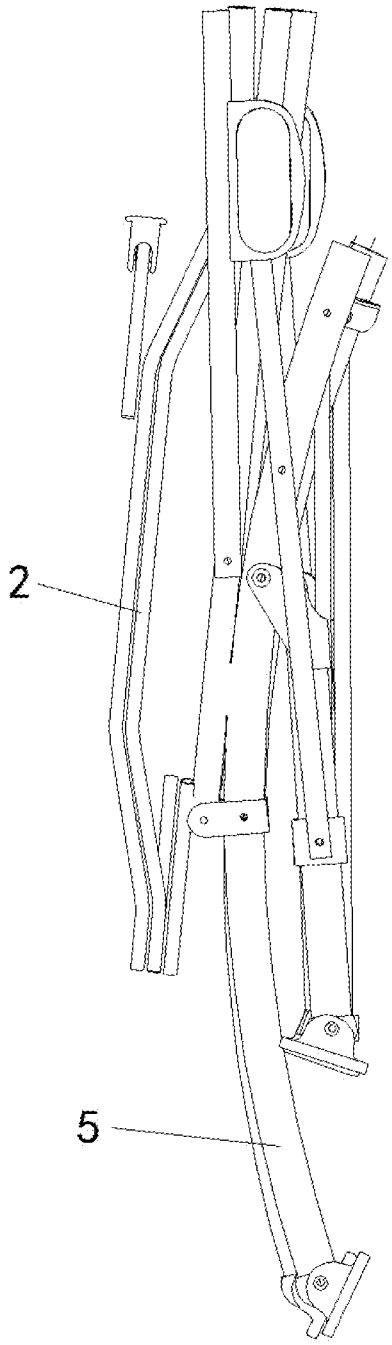
FIG. 6 is a schematic view of the chair frame provided according to the embodiment of the present application after the chair frame is folded.
Figure 8:
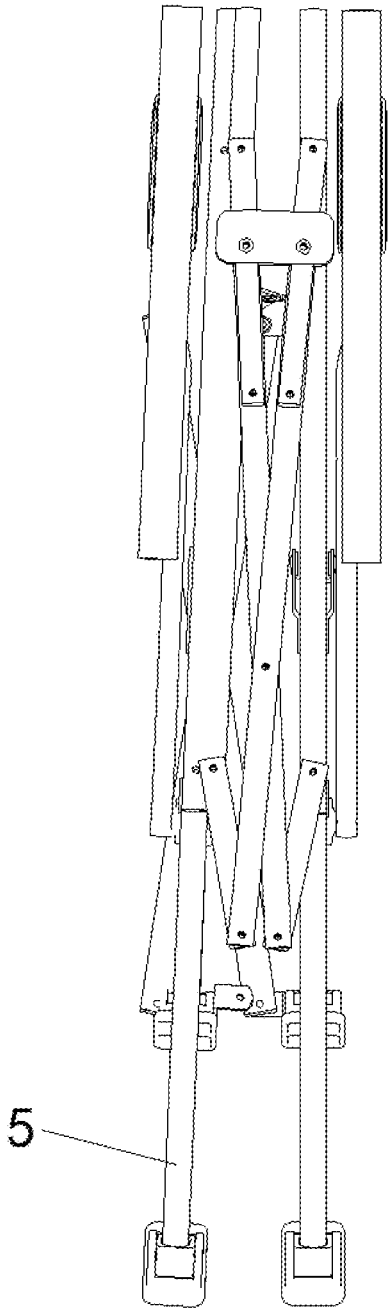
FIG. 8 is a front view of the chair frame provided according to the embodiment of the present application after the chair frame is folded.
Figure 7:
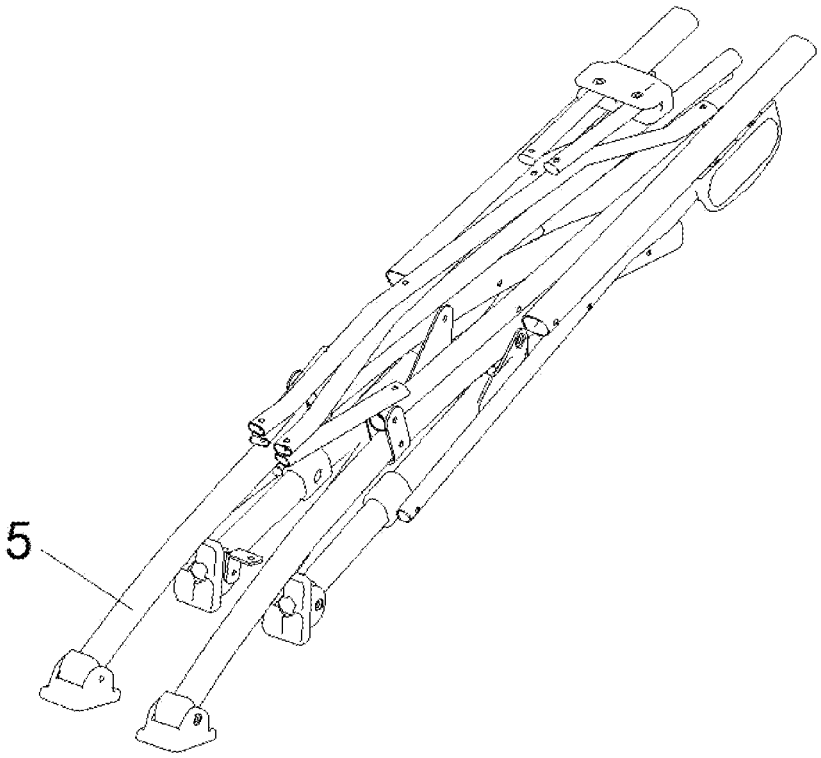
FIG. 7 is a side view of the chair frame provided according to the embodiment of the present application after the chair frame is folded.

Referring to FIG. 1 to FIG. 8, a chair frame is provided according to an embodiment of the present application, which includes: two backrest tubes 1, two cross tubes 2, a lock catch 3 and two backrest supporting tubes 4, where the two backrest tubes 1 are oppositely arranged and are respectively located on two sides. The two cross tubes 2 are provided between the two backrest tubes 1. The two cross tubes 2 are crosswise arranged and are rotatably connected to each other, that is, the two cross tubes 2 are overlapped, and a rotation shaft or the like (e.g., a pin) is provided at the overlap position to realize the rotational pivoting type of connection.

The top of each cross tube 2 is operatively rotatably connected to the corresponding backrest tube 1, that is, each backrest tube 1 is rotatably connected with one cross tube 2. The lock catch 3 and the two backrest supporting tubes 4 are provided between the two cross tubes 2. The two backrest supporting tubes 4 are respectively located at two ends of the lock catch 3. Adjacent ends of the two backrest supporting tubes 4 are rotatably connected to the lock catch 3, and the other ends of the two backrest supporting tubes 4 are respectively rotatably connected to different cross tubes 2.

It can be seen that when the chair frame needs to be unfolded or expanded, the lock catch 3 is pressed down, so that the two backrest supporting tubes 4 are unfolded toward two sides to drive the two cross tubes 2 to be unfolded. An included angle between the two cross tubes 2 becomes larger. Thus, the two backrest tubes 1 move away from each other, and a distance between the two backrest tubes 1 becomes larger, so that the chair frame is unfolded. On the contrary, when the chair frame needs to be folded, the lock catch 3 is pulled upward, the two backrest supporting tubes 4 are folded and form an inverted V to drive the two cross tubes 2 to be folded. The included angle between the two cross tubes 2 becomes smaller. Thus the two backrest tubes 1 move toward each other, and the distance between the two backrest tubes 1 becomes smaller, so that the chair frame is folded.

The two cross tubes 2 have a same size and are symmetrically arranged. The rotational connection position of the two cross tubes 2 is equidistant from the two backrest tubes 1, and the two backrest supporting tubes 4 have a same size and are symmetrically arranged, so as to ensure that the left side and the right side of the chair frame are symmetrically arranged, so the structure of the chair frame is balanced with reliable usage.

The bottom of each backrest tube 1 is operatively rotatably connected with a corresponding seat tube 5. One end of the seat tube 5 is extends downward and is configured to stand on the ground. The other end of the seat tube 5 is configured to extend upward. The seat tube 5 is further operatively rotatably connected to the top of a corresponding front leg tube 6. The bottom of a front supporting tube 7 is operatively slidingly and rotatably connected with the corresponding front leg tube 6. The bottom of the front supporting tube 7 may be provided with a sleeve 7A around the front leg tube so the front support tube 7 is slidable along a length direction of the front leg tube 6. The bottom of the front supporting tube 7 is further rotatable relative to the front leg tube 6, for instance, with a pivot connection to the sleeve 7A. The top of the front supporting tube 7 is operatively rotatably connected with a corresponding armrest tube 8, and an end of the armrest tube 8 is rotatably connected to the corresponding backrest tube 1.

The seat tube 5 not only functions as a seat for the user, but also functions as a rear leg tube to stand on the ground. The seat tube 5 can be arranged as a bent tube. During use, one end of the seat tube 5 is cocked, and the cocked end of the seat tube 5 is supported by the front leg tube 6. The seat tube 5 is operatively rotatably connected to the top of the front leg tube 6, and the seat tube 5 is operatively rotatably connected to the bottom of the backrest tube 1. When the chair frame needs to be folded, the seat tube 5 rotates relative to the backrest tube 1, so that the seat tube 5 and the backrest tube 1 are substantially parallel, and the front leg tube 6 rotates relative to the seat tube 5, so that the front leg tube 6 abuts against the seat tube 5, thereby reducing the occupied space.

A lower portion of the backrest tube 1 is operatively rotatably connected with the armrest tube 8. One end of the armrest tube 8 is rotatably connected to the backrest tube 1, and the other end of the armrest tube 8 is rotatably connected to the top of the front supporting tube 7. The bottom of the front supporting tube 7 and the bottom of the front leg tube 6 are rotatable. With such arrangement, when the chair frame is unfolded or expanded, the bottom of the front supporting tube 7 slides to the bottom of the front leg tube 6, and the armrest tube 8 is supported by the front supporting tube 7, so that a user can sit therein. During folding, the armrest tube 8 rotates upward relative to the backrest tube 1 to drive the front supporting tube 7 to slide upward relative to the front leg tube 6, and the front supporting tube 7 also rotates relative to the front leg tube 6. In addition, the front leg tube 6 rotates relative to the seat tube 5, so that the front leg tube 6 abuts against a lower portion of the seat tube 5, and the bottom of the front supporting tube 7 moves toward the end, supported on the ground, of the seat tube 5, so that the chair frame is folded.

Gear-like teeth are provided inside each armrest tube 8, and different gear-like teeth of the armrest tube 8 cooperate with the top of the corresponding front supporting tube 7 by rotating the backrest tube 1, to adjust an angle between the backrest tube 1 and the corresponding seat tube 5.

Multiple grooves which are distributed side by side are defined inside the armrest tube 8, so as to form different gear-like teeth. The top of the front supporting tube 7 is provided with a clamping insert that can engage with any one of the grooves. When the armrest tube 8 is pulled up with the backrest tube 1 as an axis, the groove is disengaged from the clamping insert, and at this time a position of the front supporting tube 7 can be adjusted. Since the front supporting tube 7 is connected to the seat tube 5, and the seat tube 5 is connected to the backrest tube 1, a relative positional relationship between the seat tube 5 and the backrest tube 1 can be adjusted to change a pitch angle of the backrest tube 1, thereby realizing different angles of sitting.

In order to ensure a stable relative position of the two seat tubes 5, two front cross tubes 9 are rotatably connected to each other between the two seat tubes 5. The two front cross tubes 9 are crosswise arranged, one end of each front cross tube 9 is rotatably connected to the corresponding seat tube 5, and the other end of the front cross tube 9 is connected to the bottom of the corresponding front leg tube 6.

When the chair frame is unfolded and expanded, an included angle between the two front cross tubes 9 is the largest, and the two front cross tubes 9 respectively support the two seat tubes 5, so as to ensure relative positional relationship among the seat tubes 5, the front leg tubes 6 and the front supporting tubes 7 is stable and firm. When the chair frame needs to be folded, the included angle between the two front cross tubes 9 is relatively small, so that the two seat tubes 5 and the two armrest tubes 8 are close to each other, so that the chair frame is folded.

The rotational connection position of the two front cross tubes 9 is equidistant from the two seat tubes 8, and the two front cross tubes 9 have a same size and are symmetrically arranged, so as to ensure that the structure of the chair frame is reasonable, prolong the service life of the chair frame, and ensure the reliable usage of the chair frame.

The bottom of each of the two cross tubes 2 is rotatably connected to one end of a corresponding backrest transverse supporting tube 10, and the other ends of the two backrest transverse supporting tubes 10 are rotatably connected to different backrest tubes 1 respectively. With such arrangement, the two backrest tubes 1 are supported by the two cross tubes 2 and the two backrest transverse supporting tubes 10, so as to ensure that the relative position of the two backrest tubes 1 is stable and reliable. When the chair frame needs to be folded, the lock catch 3 is pulled upward, the two backrest supporting tubes 4 are folded, and the two backrest transverse supporting tubes 10 rotate toward different directions, and the distance between the two backrest tubes 1 becomes smaller, so that the chair frame is folded.

The two cross tubes 2 have a same size and are symmetrically arranged, and the two backrest traverse supporting tubes 10 have a same size and are symmetrically arranged. Such arrangement can ensure that the left side and the right side of the chair frame are symmetrically arranged, and the structure of the chair frame is reasonable, and ensure the usage reliability of the chair frame.

The rotational connection position of the front leg tube 6 and the seat tube 5 is closer to the corresponding backrest tube 1 than the rotational connection position of the front supporting tube 7 and the seat tube 5. The front supporting tube 7 is located on an outer side of the front leg tube 6, the bottom of the front supporting tube 7 is slidably connected to the front leg tube 6, and the bottom of the front supporting tube 7 is rotatable relative to the front leg tube 6. When the chair frame is unfolded, the front leg tube 6 is closer to the backrest tube 1 than the front supporting tube 7, and the bottom of the front supporting tube 7 slides to the bottom of the front leg tube 6. In this way, the front leg tube 6 and the front supporting tube 7 are respectively rotatably connected to different positions of the corresponding seat tube 5, so that the structural design of the chair frame is more reasonable, which ensures that the seat tubes 5 are more uniformly stressed and the sitting is reliable.

The two cross tubes 2 and the two backrest transverse supporting tubes 10 are arranged on an inward side of the backrest tubes 1 laterally away from the front supporting tubes 7. As the backrest structure of the chair frame, the two cross tubes 2 and the two backrest transverse supporting tubes 10 are more rearward than the backrest tubes 1, which can support the back of the user, improve the sitting comfort, and provide a better use experience.

A foldable chair having a chair frame is provided according to an embodiment of the present application, which includes the chair frame described in the above specific embodiments. Other parts of the foldable chair can refer to the prior art, which will not be described herein. An elastic fabric with meshes is provided on the chair frame. The elastic fabric is arranged between the two seat tubes 5 and the two backrest tubes 1. The elastic fabric is used to replace the soft fabric in the related technology, and the meshes have the function of heat dissipation, so that the foldable chair with this arrangement has better sitting comfort and is more comfortable. Moreover, the weight of the foldable chair can be effectively controlled, so that the chair is convenient to carry and use.

It should be noted that, relationship terms herein such as first and second are merely used to distinguish an entity from other entities and do not require or imply that there are any such actual relationships or sequences between these entities.

The chair frame and the foldable chair having the same provided according to the present application are described in detail above. The principle and embodiments of the present application are described through specific examples herein. The description of the above-described embodiments is merely used to facilitate understanding the method and core idea of the present application. It should be noted that, for those skilled in the art, various improvements and modifications may be further made to the present application without departing from the principle of the present application, and these improvements and modifications also fall within the protection scope defined by the claims of the present application.

The invention claimed is:

1. A chair comprising a frame, the frame being foldable between an expanded configuration and a folded configuration, the frame comprising two backrest tubes arranged on laterally opposite sides of the frame, the frame having two cross tubes arranged crosswise and extending between the two backrest tubes, the two cross tubes being rotatably connected to each other, a top of each cross tube being operatively rotatably connected to the corresponding backrest tube, the frame comprising a lock catch and two backrest supporting tubes disposed between the two cross tubes, the two backrest supporting tubes extending from respectively lateral sides of the lock catch, the two backrest supporting tubes having ends operatively rotatably connected to the lock catch with an opposite end of the two backrest supporting tubes being rotatably connected to the corresponding cross tube; the frame having backrest transverse supporting tubes, a bottom of each of the two cross tubes is operatively rotatably connected to an end of the corresponding backrest transverse supporting tube, and an opposite end of the backrest transverse supporting tube is operatively rotatably connected to the corresponding backrest tube in a manner such that the corresponding backrest transverse supporting tube rotates toward and away from the lock catch when the frame is folded between the expanded configuration and the folded configuration, whereby when the frame is in the folded configuration, the backrest transverse support tube is generally parallel to the corresponding backrest tube.

2. The chair according to claim 1, wherein the bottom of each backrest tube is operatively rotatably connected with a corresponding seat tube, one end of the seat tube is configured to be supported on a support surface, the other end of the seat tube is configured to extend upward, the seat tube is further operatively rotatably connected to a top of a corresponding front leg tube.

3. The chair according to claim 2, further comprising a front supporting tube, the front supporting tube being operatively slidably connected on the front leg tube, the front supporting tube being is rotatable relative to the front leg tube, the top of the front supporting tube being operatively rotatably connected with a corresponding armrest tube with an end of the armrest tube being operatively rotatably connected to the corresponding backrest tube.

4. The chair according to claim 3, wherein the armrest tube has an internal toothing, and the top of the corresponding front supporting tube is adapted and configured to engage the toothing in different positions relative to the arm rest tube in a manner so as to permit rotating the backrest tube relative to the corresponding seat tube to adjust an angle between the backrest tube and the corresponding seat tube.

5. The chair according to claim 3 wherein a rotational connection position of the front leg tube and the seat tube is closer to the corresponding backrest tube than a rotational connection position of the front supporting tube and the seat tube.

6. The chair according to claim 3, wherein the two cross tubes and the two backrest transverse supporting tubes are arranged on a side of the backrest tube laterally inward and away from the front supporting tubes.

7. The chair according to claim 3, further comprising a slider sleeved on the front leg tube, the front supporting tube being operatively connected to the slider.

8. The chair according to claim 2, wherein the chair frame further comprises two front cross tubes are arranged crosswise and rotatably connected to each other, one end of each front cross tube is rotatably connected to the corresponding seat tube, and an opposite end of the front cross tube is connected to the bottom of the corresponding front leg tube.

9. The chair according to claim 8, wherein a rotational connection position of the two front cross tubes is equidistant from the two seat tubes.

10. The chair according to claim 2, wherein a rotational connection position of the two cross tubes is equidistant from the two backrest tubes.

11. The chair according to claim 1, wherein the two cross tubes have a same size and are symmetrically arranged on the frame.

12. The chair according to claim 1, wherein the two backrest transverse supporting tubes have a same size and are symmetrically arranged on the frame.

13. A chair comprising a frame, the frame being foldable between an expanded configuration and a folded configuration, the frame having a first lateral frame portion and a second lateral frame portion, the first and second lateral frame portions being spaced apart from each other in a lateral direction when the frame is expanded, the first and second lateral frame portions being adjacent to each other when the frame is folded;

wherein the first lateral frame portion and the second lateral frame portion comprise:

a backrest tube operatively rotatably connected to a seat tube, one end of the seat tube is configured to be supported on a support surface, the other end of the seat tube is configured to extend upward;

a front leg tube, the seat tube being operatively rotatably connected to a top of the front leg tube;

a front supporting tube, the front supporting tube being operatively slidably connected on the front leg tube, the front supporting tube being rotatable relative to the front leg tube;

an armrest tube, the top of the front supporting tube being operatively rotatably connected with the armrest tube with an end of the armrest tube being operatively rotatably connected to the backrest tube; and the frame further comprises:

two cross tubes arranged crosswise and extending between the first second lateral frame portions, the two cross tubes being rotatably connected to each other, a top of each cross tube being operatively rotatably connected to the backrest tube of the respective first and second lateral frame portion;

a lock catch disposed between the two cross tubes;

two backrest supporting tubes each with first and second ends, the first end of each back rest supporting tube being operatively rotatably connected with the lock catch on opposite sides of the lock catch such that one backrest support tube extends outward from one side of the lock catch and the other backrest support tube extends outward from the opposite side of the lock catch, the second ends of the backrest supporting tubes being connected with corresponding backrest tube of the respective first and second lateral frame portions; and two backrest transverse supporting tubes each with first and second ends, the first end of each backrest transverse supporting tube being operatively rotatably connected with a bottom of a cross tube, the second ends of the backrest transverse supporting tubes being operatively rotatably connected with corresponding backrest tubes of the respective first and second frame portions.

14. The chair according to claim 13, wherein the armrest tube of each of the first and second frame portions has an internal toothing, and the top of the corresponding front supporting tube is adapted and configured to engage the toothing in different positions relative to the arm rest tube in a manner so as to permit rotating the backrest tube relative to the corresponding seat tube to adjust an angle between the backrest tube and the corresponding seat tube for each of the first and second frame portions.

15. The chair according to claim 13, further comprising two front cross tubes arranged crosswise and extending between the first and second lateral frame portions, the two front cross tubes being rotatably connected to each other, one end of each front cross tube being operatively rotatably connected to the seat tube, and an opposite end of the front cross tube is operatively connected to the bottom of the corresponding front leg tube for each of the first and second lateral frame portions.

16. The chair according to claim 13 wherein on each of the first and second lateral frame portions, a rotational connection position of the front leg tube and the seat tube is closer to the corresponding backrest tube than a rotational connection position of the front supporting tube and the seat tube.

17. The chair according to claim 13, wherein the two cross tubes have a same size and are symmetrically arranged on the frame.

18. The chair according to claim 13, wherein the two backrest transverse supporting tubes have a same size and are symmetrically arranged on the frame.

19. The chair according to claim 13, further comprising a slider sleeved on the front leg tube on each of the first and second lateral frame portions, the front supporting tube being operatively connected to the slider.

* * * * *